US005100203A

United States Patent [19]

Novak

[11] Patent Number: 5,100,203

[45] Date of Patent: Mar. 31, 1992

[54] COLLAPSIBLE PORTABLE SLAT SEAT

[75] Inventor: Leslie A. Novak, Newburyport, Mass.

[73] Assignee: HowdaDesignz, Inc., Newbury, Mass.

[21] Appl. No.: 540,750

[22] Filed: Jun. 20, 1990

[51] Int. Cl.[5] ..... A47C 4/00

[52] U.S. Cl. ..... 297/382; 297/380

[58] Field of Search ..... 297/380, 382, 454; 160/230, 231.1, 404

[56] References Cited

U.S. PATENT DOCUMENTS

| | | | |
|---|---|---|---|
| 1,852,323 | 4/1932 | Long | 160/231.1 |
| 2,001,252 | 5/1935 | Johnson | 297/382 |
| 3,139,307 | 6/1964 | Hawley et al. | 297/452 X |

*Primary Examiner*—Peter R. Brown

*Attorney, Agent, or Firm*—Zarley, McKee, Thomte, Voorhees & Sease

[57] ABSTRACT

A collapsible and foldable composite chair with back slats and seat slats attached to a flexible fabric material. The slats are fixedly and securedly attached to pockets in the flexible material by a unqiuely positioned and arranged staple system which minimizes damage to the fabric and the slats and which enhances the co-action therebetween.

9 Claims, 1 Drawing Sheet

COLLAPSIBLE PORTABLE SLAT SEAT

BACKGROUND INVENTION

This invention relates to an improvement in collapsible portable slat seats of the type generally described in Johnson U.S. Pat. No. 2,001,252, issued May 14, 1935. Generally speaking, these types of foldable chairs involve a relatively simple collapsible and foldable composite chair with a back and a seat, and the back and the seat each formed primarily of a series of slats held in co-active relation to each other by fabric and by lateral straps extending from the seat to the back. As a result, the chair may be in conventional chair use or upright position and can be collapsed and rolled up to a non-use storage position.

Chairs of the type generally referred to in the Johnson Patent have met with some degree of success in the past for use at sporting events, on the beach, and the like. They are easily toted, easily set up, highly functional and lightweight. However, in dealing with the collapsible slat chairs of the type described in the Johnson Patent, certain deficiencies have become apparent and perhaps explain why that general seat system disappeared from the commercial marketplace long ago.

In particular, the Johnson Patent system describes that the slats are either free fitting within the pockets of the flexible material holding the slats in parallel relation, or alternatively may be fastened by means such as rivets.

In working with these chairs where the slats are either free or riveted, certain significant failures have become apparent. In particular, rivets necessarily involve placing a hole in the wooden slats first then a similar hole through the canvas. In using heavy durable canvas for the flexible material to hold the slats in their proper relationship, it is inconvenient for shooting a rivet unless the wooden material and the canvas are drilled so as to not tear the canvas in the process. The hole in the wood is undesirable in that it allows for more chances of fracture and splitting of the wood and significantly deteriorates its integrity. Moreover, rivets are costly. Thus, it is desirable to avoid use of rivets because it fatigues the overall structure as well as significantly increases the expense.

In contrast to the suggestion of the Johnson Patent, it has been discovered that free-end insertion into the pockets is unsatisfactory. This is unsatisfactory because it allows each of the slats to be independently laterally moved. Thus, it decreases significantly one of the advantages of the collapsible chair, namely, that the fabric material holds them in a relationship which allows them to co-act to create a hugging feeling for the person sitting in the chair. If the slats can independently move in relationship to the canvas or other material, they can become out of general parallel alignment, causing the chair to improperly fit the user. Moreover, where free or loose pockets are used in conjunction with the ends of the wooden slats, extremely close tolerance levels are demanded in forming the pockets by stitching, as later described. Such precise measurements do not allow for much factory tolerance if the wood is to be held tightly. Moreover, if the tolerances are very close, the process of inserting the wooden slats into the pockets becomes difficult because of the tight fit required to maintain the chair integrity. Moreover, because the wooden slats do very slightly in thickness from run to run, it also becomes impossible to manufacture these chairs in bulk without significant waste, i.e., oversized slats, undersized pockets, etc.

It can, therefore, be seen that there is a real and continuing need for increased efficiencies, both in manufacturer, product integrity and product cost for the foldable, collapsible, slatted chairs of the type referred to herein. It is a primary objective of the present invention to fulfill this need.

SUMMARY OF THE INVENTION

Collapsible and foldable chairs provided with back slats and seat slats are formed from a series of slats held in proper relationship to each other by a flexible fabric material having defined pockets and by straps extending from the seat to the back. The slats are fixedly and securedly attached to the pockets formed in the flexible material by a uniquely designed and arranged staple system. In particular, the staples used are divergent closure staples, inserted in a special manner to avoid any significant impact on integrity of either the fabric material or the slats.

DETAILED DESCRIPTION OF THE INVENTION

Figure 1:
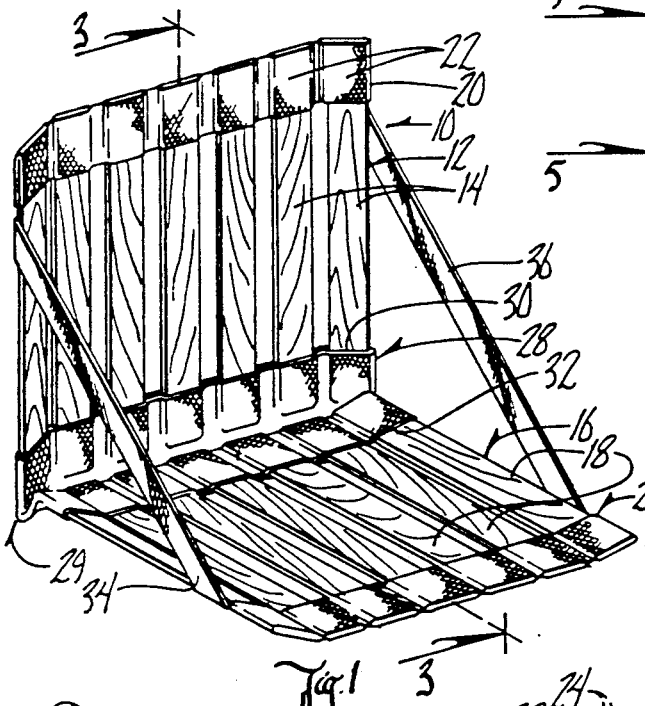
FIG. 1 is a perspective view of the collapsible chair of this invention.
Figure 2:
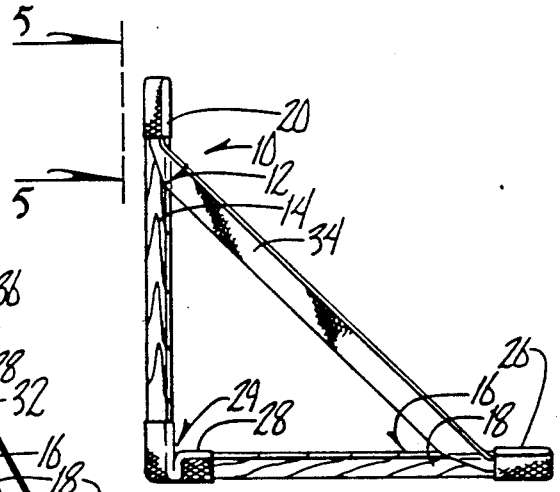
FIG. 2 is an elevated side view of the chair of the present invention.

FIG. 1 shows the chair 10 in use position. There it can be seen that the back 12 of chair 10 consists of a plurality of substantially parallel slats 14. In similar fashion, the seat 16 consists of a series of substantially parallel slats 18. Preferably, slats 14 and 18 are made of basswood, although other suitable structural materials would work as well. A first flexible connecting material 20, which ideally is canvas, extends over one end of the slats 14 and has a series of pockets 22 formed in the fabric material 20, particularly defined by stitching 24.

A second flexible material 26 is similarly configured and stitched to one end of the seat slats 18.

A third flexible connector material 28 is stitched to form a fold line 29, define a series of inner back pockets 30 and inner seat pockets 32, and generally forms a folded piece of textile fabric.

Figure 7:
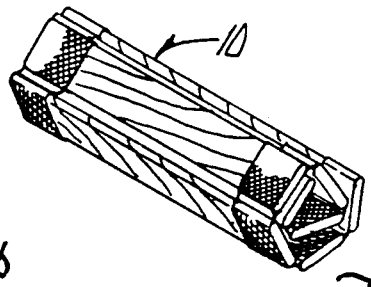
FIG. 7 shows the chair in folded-up storage position.
Figure 3:
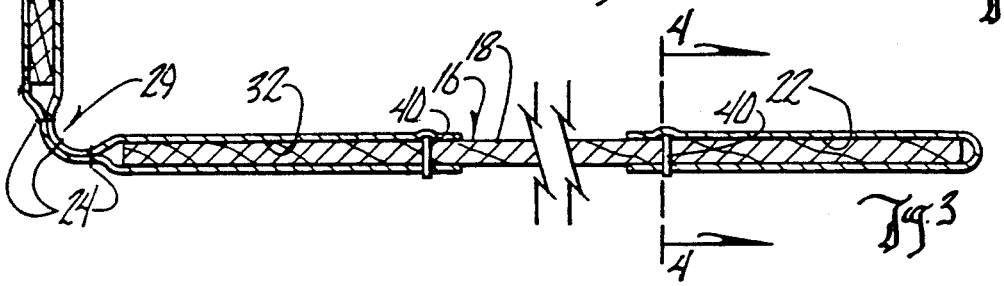
FIG. 3 shows the view of the chair in partial section to show the stitching arrangement and staple arrangement for the pockets.

Lateral or side straps 34 and 36 can be formed of canvas webbing and generally hold the back in proper relation to the seat when in use. The seat can be collapsed along fold line 29 and rolled to an at-rest or storage position as illustrated in FIG. 7.

Figure 6:
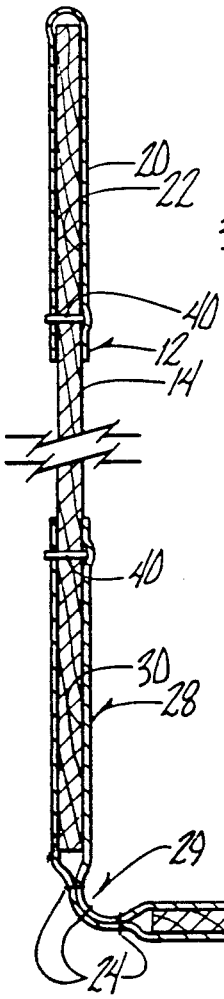
FIG. 6 is a plan view of the chair in use.
Figure 6:
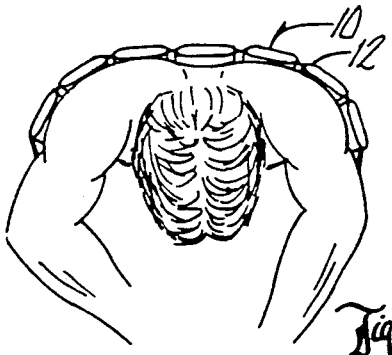

In actual use, the seat conforms to the back and sides of the user as illustrated in FIG. 6 to give the feeling of a hug.

Figure 4:
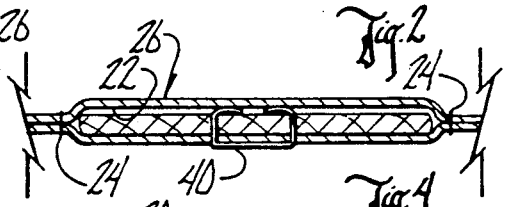
FIG. 4 is a sectional view along line 4—4 of FIG. 3 showing how the divergent closure staples pass through one side of the pocket, through the slats, and diverge back into the slat again without interfering with the opposing pocket wall.
Figure 5:
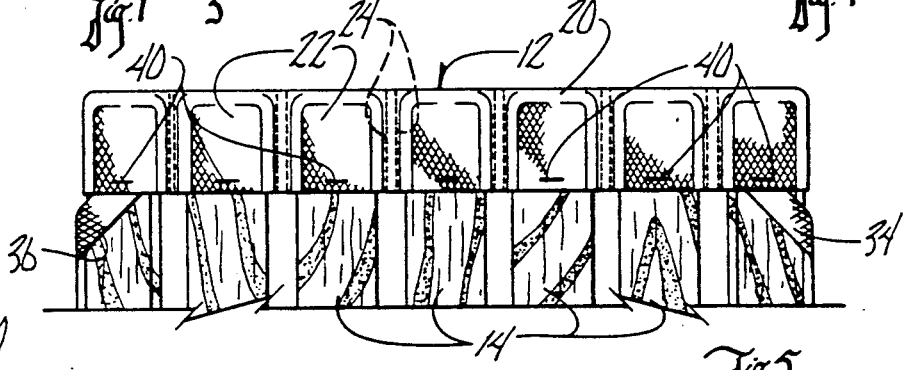
FIG. 5 shows how the slats are secured into the pockets on the exterior side of the seat.

Slats 14 of back 12, and 18 of seat 16 are held securely in their respective pockets by at least one divergent closure staple which extends from the backside through the canvas, through the wooden slat, and hooks back into the slat as illustrated in FIG. 4. The divergent closure staple is designated herein at 40. It can be seen that the staples do not interfere in any way with the back of the user since they are on the backside of the chair. The staples are especially designed divergent closure staples which do not in any way affect either the integrity of the canvas material or the slats. They are inserted in the following manner.

A metal insert generally the same width in configuration of the slats is inserted on the user side of the chair upwardly into the pocket in abutting relationship with the slat. On the opposite or backside of the chair, a staple gun carrying divergent closure staples is pressed against the canvas material and the staple shot. It passes through the canvas, through the slat, abuts against the metal insert and diverges back into the wood as illustrated in FIG. 4. The metal insert is then removed. In this manner, the slats and the canvas are secured without weakening the frame of the unit, without weakening the canvas, and in fact, in a manner which enhances the co-acting operability of both to provide a chair giving the user that desirable hugging feeling.

Moreover, because integrity has not been sacrificed, the chair lasts longer. Also, the use of this stapling system and method of staple insertion is cost-effective compared to the use of rivets. The lateral straps 36 and 38 are similarly attached. Preferably, there are at least four of the staples 40 of the type described herein, if not more, used on the ends of the slats for each of straps 34 and 36. It also is desirable in some instances to use a glue in conjunction with the fastening of the slats or straps in order to increase integrity.

It can be seen in operation that this system does not expose the user or his clothing to the fastening means in any way. Thus, comfort is assured, and the possibility of either tearing of the skin or clothing is eliminated. Moreover, the difficulties associated with loose pockets and assembly of the chair are avoided. Also, slat integrity is not sacrificed.

It, therefore, can be seen that the invention accomplishes at least all of its stated objectives.

I claim:

1. A foldable and portable chair having a back and a seat each formed of a plurality of substantially parallel slats having opposite ends, a first flexible connecting material having defined pockets therein for receipt of one end of said slats of said back;

a second flexible connecting material having defined pockets therein for receipt of one end of said slots of said seat;

a third flexible connector material having defined pockets therein adapted for receipt of the other end of said back and seat slats to form a flexible connected set of back and seat slats;

each of said pockets having an interior and exterior pocket wall;

collapsible straps attached to the lateral slats of the back and the lateral slats of the seat to hold the back and seat in proper relation for use;

each end of said slats being fixedly secured to one exterior wall of said pockets by divergent closure staple means said interior wall of said pocket remaining loose with respect to said slats.

2. The chair of claim 1 wherein the staple means passes through said flexible material, through said slat, and turns back upon itself into said slat.

3. The chair of claim 2 wherein said collapsible straps are fixedly connected to the lateral slats of said back and seat by divergent closure staples.

4. The chair of claim 1 wherein said slats are of basswood.

5. The chair of claim 1 wherein said flexible material is a fabric material.

6. The chair of claim 5 wherein said flexible fabric material is canvas.

7. The chair of claim 6 wherein said pockets are stitched pockets integrally formed in said canvas.

8. The chair of claim 7 wherein each end of said slat is glued to its respective pocket.

9. The chair of claim 7 wherein said straps are glued to the slats.

* * * * *